United States Patent [19]

Matsuzaki et al.

[11] Patent Number: 4,596,615

[45] Date of Patent: Jun. 24, 1986

[54] METHOD OF COOLING HOT STEEL PLATES

[75] Inventors: Katsushige Matsuzaki; Masahiro Doki; Masato Sanazawa; Masanao Yamamoto, all of Kimitsu; Hiroki Miyawaki, Kitakyushu, all of Japan

[73] Assignee: Nippon Steel Corporation, Tokyo, Japan

[21] Appl. No.: 703,384

[22] Filed: Feb. 20, 1985

[30] Foreign Application Priority Data

Feb. 20, 1984 [JP] Japan ..... 59-28666

[51] Int. Cl.[4] ..... C21D 1/18; C21D 11/00

[52] U.S. Cl. ..... 148/128; 148/156; 72/201

[58] Field of Search ..... 148/128, 143, 155, 157, 148/156; 72/201; 266/80, 87, 88, 90

[56] References Cited

U.S. PATENT DOCUMENTS 3,525,507 8/1970 Geipel et al. ..... 266/87
3,533,261 10/1970 Hallander et al. ..... 266/87
4,440,584 4/1984 Takeshige et al. ..... 148/128

FOREIGN PATENT DOCUMENTS 2371978 7/1978 France ..... 148/128
41317 3/1982 Japan ..... 148/143

*Primary Examiner*—Christopher W. Brody
*Attorney, Agent, or Firm*—Wenderoth, Lind & Ponack

[57] ABSTRACT

Hot steel plate as hot-rolled is passed forward longitudinally through pairs of top and bottom rollers disposed in the direction of the plate travel. The steel plate is cooled with water supplied to its top and bottom surfaces from the nozzles on a plurality of cooling units disposed in the same longitudinal direction. Each cooling unit is disposed between adjoining pairs of the top and bottom rollers. Before cooling is started, the temperature distribution in the steel plate is determined and the desired mean cooling rate is set. The distance from the plate edge over which the supply of the cooling water at least to the bottom side of the plate is to be cut off is determined for each cooling unit on the basis of the determined temperature distribution and preset mean cooling rate. By so doing, the temperature of the inner edge portion of the steel plate is kept above the temperature of the middle portion, thereby allowing the $Ar_3$ transformation in the inner edge portion to occur simultaneously with or after the $Ar_3$ transformation in the middle portion. The cooling water directly supplied to the edge portion of the steel plate is cut off over the distance thus determined.

5 Claims, 17 Drawing Figures

METHOD OF COOLING HOT STEEL PLATES

BACKGROUND OF THE INVENTION

1. Field of the Invention

This invention relates to a method of applying controlled cooling on hot steel plates, and more particularly to a method of applying controlled cooling on hot steel plates without impairing the shape thereof.

2. Description of the Prior Art

With the reduction of alloying elements, efficient utilization of heat, and development of new steels in view, many studies have been made recently on what are generally called thermal-refining cooling processes for plate production in which heating with controlled temperature and time, controlled rolling, and forced cooling immediately after rolling are combined.

The sequence of controls exercised in the heating and cooling processes are intended for achieving regulation of the transformation characteristic of steel plates and enhancement of their mechanical properties. With the metallurgical mechanisms almost fully clarified, controlled heating and rolling technologies have been widely adopted during the past 10 years as in-line production processes, principally in the manufacture of high-strength line pipe steels for low-temperature and cryogenic services. For forced cooling technology, on the other hand, temperature and shape controls have not yet reached a level high enough to permit in-line incorporation and stable operation, though adequate light has been thrown upon the metallurgical mechanisms thereof.

Forced cooling of hot steel plate is done by injecting cooling water onto both surfaces of the plate through a group of nozzles disposed widthwise over and below the plate. If the injection rate is the same across the entire plate width, significant temperature difference occurs between the edges and middle portion of the plate because the former gets cooled faster than the latter. The result is the impairment of plate shape due to waviness in edges and the middle, camber and other configurational irregularities.

The U.S. Pat. No. 4,440,584 discloses a method and apparatus for cooling steel plates proposed as a solution for the problem of the kind just described. According to this technology, steel plate is cooled by cutting off the supply of cooling water to the upper surface of the edge portion of the plate being cooled so that uniform widthwise temperature distribution is achieved on completion of cooling to prevent the deformation of the plate after cooling.

However, the inventors have found that the deformation of the plate cannot be fully prevented even if the supply of cooling water to the upper surface of the edge portion is cut off.

The inventors have also found that unless cooling is effected with the time at which austenite transformation at $Ar_3$ begins in the edge and middle portions in mind, great residual stress would result from the abrupt changes in the coefficient of linear expansion and yield stress that occurs with that transformation. When the plate is cooled down to ambient temperature, the residual stress will cause great enough deformation to impair the shape of the product plate beyond the tolerable limit.

SUMMARY OF THE INVENTION

The object of this invention is to provide a method of applying controlled cooling on hot steel plates without causing any deformation.

Steel plate fresh from the hot-rolling line travels in the longitudinal direction thereof while being held between pairs of top and bottom rollers disposed in that direction. The plate is cooled with cooling water injected onto both sides thereof through the nozzles in a plurality of cooling units that are also disposed longitudinally, with each unit being placed between two adjacent pairs of said top and bottom rollers. Before starting cooling, the required mean cooling rate is set by determining the temperature distribution of the plate. Then, there arises the need to keep the temperature in the edge of the plate higher than that in the middle portion so that austenite transformation at $Ar_3$ in the edge portion occurs simultaneously with or after that in the middle portion. This calls for calculating the width from each side of the plate over which the supply of cooling water is to be cut off, at least on the lower side of the plate, on the basis of the temperature distribution and mean cooling rate determined previously. Then, the supply of cooling water is cut off over the width thus determined.

With the cooling according to the method of this invention implemented in such a manner that austenite transformation at $Ar_3$ in the edge portion occurs simultaneously with or after that in the middle portion, little or no deformation takes place, with the result that production of plates with satisfactory shape is assured.

DESCRIPTION OF THE PREFERRED EMBODIMENTS

Figure 1:
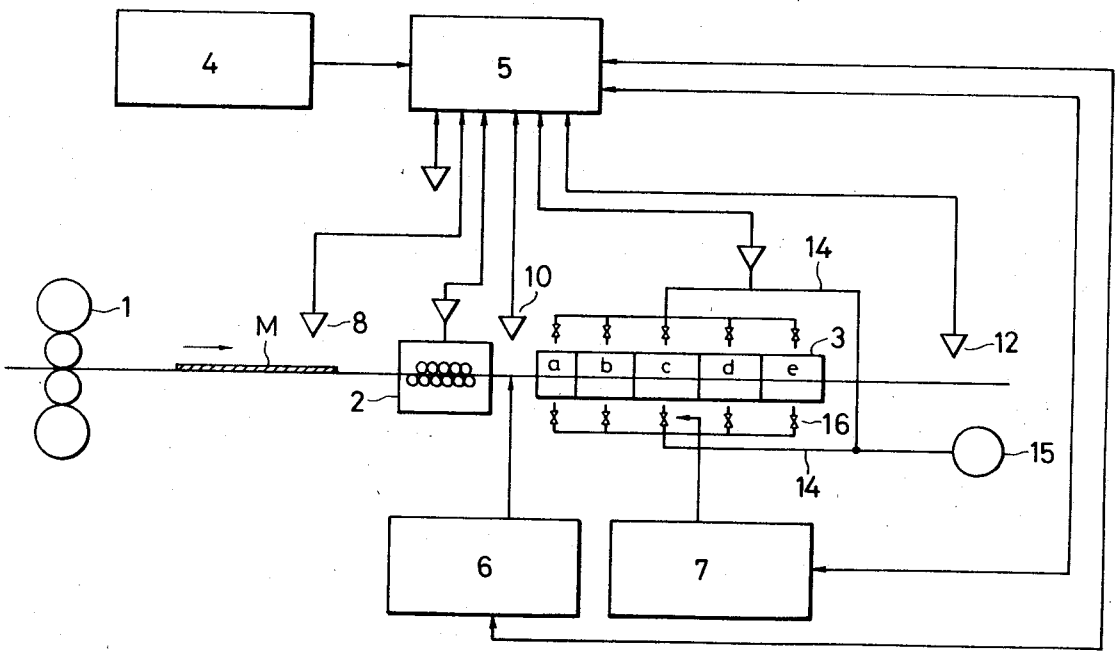
FIG. 1 is a block diagram showing the makeup of an example of the plate cooling apparatus employed for the implementation of the cooling method according to this invention.

The basic portion of the cooling method according to this invention depends upon the conventional technology.

Hot plate is cooled while being held between top and bottom rollers. The paired top and bottom rollers are driven to provide a thrust to the plate and prevent the plate being cooled from getting deformed. The paired top and bottom rollers placed between two adjoining cooling units serves as a partition to prevent the cooling water sprayed by one unit from reaching the area covered by the next unit.

Cooling water supply to the top and bottom surfaces of the plate is achieved by conventional methods. For instance, cooling water is ejected or allowed to flow out onto the plate surface through a plurality of nozzles or slit nozzles provided on a nozzle header extending breadthwise. A group of nozzles or slit nozzles disposed between two adjoining pairs of top and bottom rollers make up a cooling unit. A plurality of such cooling units are disposed in the direction in which the plate travels.

Now the elements characteristic of the method of this invention will be described.

The temperature distribution of the plate is determined on the plate fresh from the preceding process (such as hot rolling and levelling) before the cooling operation begins. This is accomplished by, for example, running a radiation pyrometer placed immediately upstream of a cooling apparatus across the width of the plate travelling forward. The obtained results are stored in the memory of a process control computer or in other appropriate storage device.

The mean cooling rate to be set before starting cooling depends upon the mechanical properties required of product plates. The mean cooling rate is obtained by averaging across the plate thickness. Since the cooling rate varies with the position on plate (e.g., from middle to edge), the one at a given point fixed with respect to plate width is used as the representative rate. It is preferable to set the mean cooling rate at a point in the middle of plate where temperature variation is minimal. The established mean cooling rate is stored, together with the aforesaid temperature distribution data, in the same storage device.

According to the method of this invention, hot plate is water-cooled in such a manner as to make the temperature in the edge portion higher than that in the middle portion, thereby ensuring that transformation at the $Ar_3$ point in the former area takes place simultaneously with or after that in the latter area.

The water cooling is carried out at least while the temperature of the hot plate remains within the $Ar_3$ transformation region. Here the $Ar_3$ transformation region means a region in which 10 to 90 percent of solid-soluble gamma iron transforms into solid-soluble alpha iron. Accordingly, the water cooling is started at a temperature not lower than the $Ar_3$ transformation point and continued at least to a point where the temperature falls below the same transformation point. For example, the water cooling is started at a temperature between 650° C. and 850° C. and terminated at a temperature between 300° C. and 500° C.

According to the data of actual measurements, the temperature in the edge portion of un-cooled steel plate falls sharply toward the edge. In the area some distance away from the edge, the rate of temperature drop grows increasingly moderate toward the center, with a substantially equal temperature kept over a considerably wide area. With a steel plate 32 mm thick and 3200 mm wide, for example, the temperature dropped by 55° C. in a region within 200 mm of the edge while the temperature in other portions remained substantially unchanged in the vicinity of 750° C. In the description of this invention, a portion closer to the plate edge where sharp temperature drop takes place is called the edge portion. The edge portion extends over a distance of 500 mm or less from the plate edge irrespective of the plate width. Immediately before cooling, the temperature in the edge portion becomes lower than that in the middle portion by a maximum of 10° C. to 100° C. as averaged across the plate thickness.

In practice, however, there is no need to ensure that the $Ar_3$ transformation in the entire area of the edge portion should occur not earlier than in the middle portion. In other words, the $Ar_3$ transformation in the portion very close to the plate edge may be allowed to occur earlier than in the middle portion since the plate deformation that might result therefrom is so slight and tolerable for practical purposes. The plate edge and a portion very close thereto are collectively called the outer edge portion. A portion that remains after excepting the outer edge portion from the edge portion is called the inner edge portion. The outer edge portion, the width of which varies with the widthwise temperature distribution in the un-cooled plate and plate width, usually extends approximately 50 mm or less from the plate edge toward the center.

In comparing the temperatures of the inner edge portion and the middle portion, the temperature averaged over the thickness at the boundary between the outer and inner edge portions or at a point somewhat (by approximately 100 mm) closer to the center is used as the temperature of the inner edge portion. Namely, the temperatures in the inner edge portion are represented by the temperature at such a selected point. The temperature in the edge portion drops sharply toward the plate edge as mentioned previously. Even when the temperature of a point on the inside of said boundary is taken as the representative temperature, however, the temperature at the boundary is kept higher than that in the middle if the representative temperature is adequately higher than the temperature in the middle.

The position where the representative temperature of the inner edge portion is determined is decided empirically by taking into consideration the temperature distribution in the un-cooled plate, variations in temperature measurements, the width over which cooling water supply is to be cut off, and other parameters. In order to keep the temperature of the inner edge portion higher than the temperature in the middle, the supply of cooling water from the nozzle to the plate surface is cut off over a certain width. By so doing, the cooling rate in the inner edge portion is kept lower than the cooling rate in the middle portion at least until the $Ar_3$ transformation begins.

The water-supply cut-off range is derived from the widthwise temperature distribution in the uncooled plate and the mean cooling rate. The desired value is empirically determined beforehand by using the temperature distribution and mean cooling rate as variables. The obtained results are stored in the memory of a process control computer or other appropriate storage device as mentioned previously so that the desired cut-off width can be determined as the temperature distribution and other parameters change.

The water-supply cut-off width is determined for each cooling unit, and also for each of the top and bottom sides when cooling water is supplied from the top and bottom nozzles. The hot plate gets cooled while passing through a plurality of cooling units one after another from the entry end of a cooling apparatus. By determining the water-supply cut-off width for each cooling unit, therefore, the hot plate is cooled according to the desired cooling rate and at temperatures desirable for the edge and middle portions thereof. Depending upon the cooling rate, some cooling unit may not require the water supply to be cut off over any width.

The water-supply cut-off width thus determined for each cooling unit is kept unchanged until cooling is complete unless the temperature distribution varies significantly. If the temperature distribution varies considerably, the cut-off width for each cooling unit is adjusted as required.

The water supply to the plate surface can be cut off by covering the plate edge with a shield plate or trough, by closing a valve provided on the upstream side of each nozzle, or by other appropriate method. With the shielding method, the water supply to either or both sides of the plate can be cut off as desired.

Deformation of the plate can be prevented by water-cooling the hot plate in such a manner that the transformation at the $Ar_3$ point in the edge portion occurs simultaneously with or after that in the middle portion. The mechanism by which plate deformation is thus prevented can be explained as follows:

The plate becomes deformed when any portion thereof buckles under the influence of compressive stresses. When the $Ar_3$ transformation in the edge portion occurs simultaneously with or after that in the middle portion and the plate is cooled to ambient temperature, residual tensile and compressive stresses arise in the edge and middle portions, respectively. The residual compressive stress tends to cause buckling in the middle portion. Actually, however, no buckling takes place because the area of the middle portion is appreciably larger than that of the edge portion.

Conversely, when the $Ar_3$ transformation in the edge portion occurs earlier than that in the middle portion and the plate is cooled to ambient temperature, residual compressive and tensile stresses arise in the edge and middle portions, respectively. Because the area of the edge portion is much smaller than that of the middle portion, the residual compressive stress readily causes buckling in the edge portion.

As such, if cooling is effected in such a manner as to allow the $Ar_3$ transformation to occur in the edge portion not earlier than in the middle portion, no buckling occurs and, therefore, production of steel plate with satisfactory shape is ensured.

If plate thickness is relatively small (such as 15 mm) or the cooling apparatus lacks adequate control ability, the temperature drop in the edge portion can be drastic enough to make it difficult to maintain the temperature of the edge portion higher than that of the middle portion in the $Ar_3$ transformation region by employing no other means than the cutting off of the cooling water supply. In such cases, localized heating may be applied to the edge portion, as an auxiliary measure, immediately before water cooling. Induction heating, direct-fired heating or other types of heating may be applied as required.

The cooling method according to this invention is applicable to the manufacture of high-strength and high-toughness steels, steels for line pipe, 50K steels for structural and shipbuilding uses, steels designed for use in welding involving large heat input, tempered steels for low-temperature service, non-tempered steels and many other types of steels ranging approximately between 8 mm and 100 mm in thickness.

The technique to cause the $Ar_3$ transformation in the edge portion to occur simultaneously with or after that in the middle portion is also applicable to the front and rear ends of the plate.

Preferred Embodiments

FIG. 1 shows an example of the layout of a plate rolling mill in which devices for accomplishing the plate cooling and shape control according to this invention are provided. A rolling mill 1 is followed by a leveller 2 and a cooling apparatus 3 in that order. The cooling apparatus 3 is divided, for example, into five cooling zones a, b, c, d and e.

Figure 2:
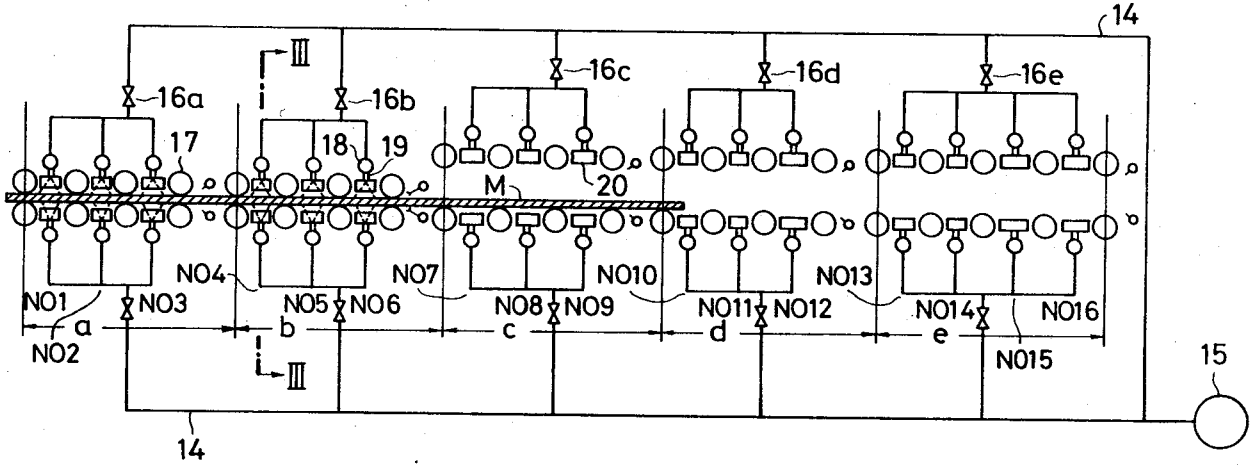
FIG. 2 is a side elevation showing an example of the arrangement of cooling units on the cooling apparatus employed for the implementation of the cooling method of this invention.

In each cooling zone are disposed three to five pairs of top and bottom rollers 17 in the direction in which plate travels forward, as shown in FIG. 2. A group of top and bottom nozzles 19 are disposed between adjoining pairs of top and bottom rollers 17. Each group of nozzles 19 are called a cooling unit and is numbered, for example, from 1 to 16 starting with the one at the entry end of the cooling apparatus. Each of the cooling units Nos. 1 through 16 has a mechanism 20 that controls the supply of cooling water as desired. The top nozzle group 19 and water-supply control mechanism 20 are adapted to be raised and lowered as desired and remain on standby in the raised position where there is no need to supply water to the top side of the plate.

Cooling water is forced to piping 14 by means of a pump 15 and thence distributed to a top and bottom header. The water is ejected against the top and bottom surfaces of plate M held between top and bottom rollers 17 through a header 18 and nozzles 19 at a rate established by a flow control valve 16 provided to each selected zone. The water supply to the edge portion of the top and bottom surfaces of the plate M is either increased or decreased as desired or totally cut off by means of the water-supply control mechanism 20.

Figure 3:
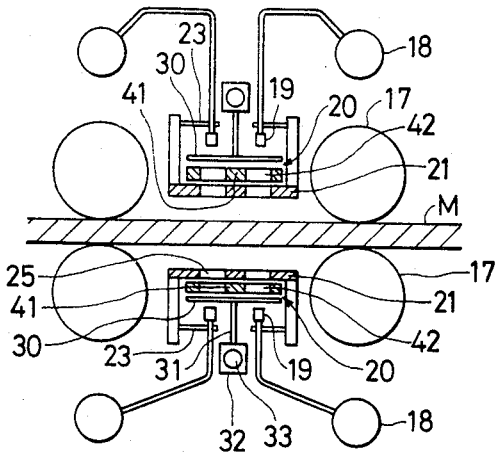
FIG. 3 is a cross-sectional view taken along the line III—III in FIG. 2.
Figure 4:
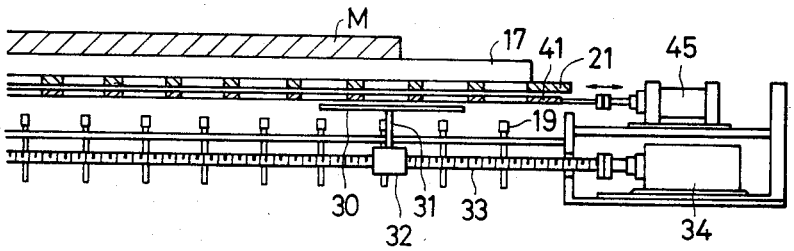
FIG. 4 is a front view showing part of the apparatus illustrated in FIG. 3.

FIGS. 3 and 4 illustrate an example of the structure of the cooling apparatus 3. As shown in the figures, the water-supply control mechanism 20 is encased in a nozzle protection apron 21. A group of nozzles 19 are fastened to a nozzle base 23 inside the apron 21. An edge-portion shield plate 30 to cut off the supply of water from a selected number of nozzles 19 near both edges of the plate M is disposed respectively below and above the top and bottom nozzles 19.

The water-supply control mechanism 20 comprises a shield-plate support rod 31, a nut 32, a screw 33 and a drive motor 34 which work in combination to set the position of the edge-portion shield plate 30. The apron 21 is perforated with holes 25 through which the cooling water passes. The position of each hole corresponds to that of each nozzle 19.

A front-end (or tail-end) shield plate 41, which extends beyond the width of the plate M, is disposed between the apron 21 and the edge-portion shield plate 30. The end shield plate 41 is perforated with water-passage holes 42 in positions corresponding to those of the holes 25 in the apron 21. The cooling water reaches the surface of the plate M when the holes in the apron 21 are mated to those in the end shield plate 41. The end shield plate 41 is adapted to be moved back and forth by means of a rod 46 of a hydraulic cylinder 45 connected to the side thereof.

Figure 5:
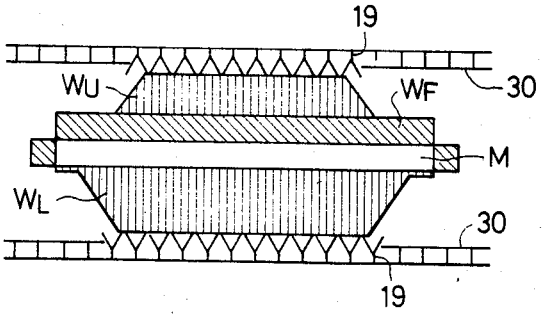
FIG. 5 shows the density of the cooling water ejected from the nozzle.

FIG. 5 schematically shows an example of the mode in which cooling water is ejected from the group of nozzles 19. The cooling water ejected from the nozzle 19 spreads in fan-shaped form when the nozzle is of the flat spray type and in conical form when the nozzle is of the full-cone spray type. With the top side of the plate M partitioned into a front and rear portion by a top roller, the cooling water supplied to the top surface of the plate flows toward both edges thereof as surface water $W_F$. Even if the direct downward cooling-water supply is cut off, the edge portion is considerably cooled by the side-flowing surface water $W_F$. On the other hand, most of the water supplied from below falls immediately after impinging on the bottom surface of the plate. As such, the bottom side of the edge portion is hardly cooled when the water supply to that portion is cut off. As will be evident from the above, cutting off the water supply to the bottom surface of the edge portion is more advantageous in accomplishing the desired type of cooling in which the edge portion should be kept at a higher temperature than the middle portion. In cutting off the water supply to the edge portion, it is therefore preferable to at least cut off the supply to the bottom side thereof. When the water supply to the edge portion is cut off, the water $W_U$ and $W_L$ above and below the plate spreads in trapezoidal form.

The way steel plate is cooled on the apparatus just described will be discussed in the following paragraphs. To begin with, heating conditions, rolling history or data, plate size and cooling conditions are stored in a process control computer 4. The middle portion of the plate is chosen as the representative point to determine the cooling conditions. The standard pre-cooling temperature, desired plate temperature to be obtained and cooling rate in the middle portion are given. Then a cooling control computer 5 determines which cooling unit to operate (the i-th unit from the entry end of the cooling apparatus), the quantities of water $q_{Ui}$ and $q_{Li}$ to be supplied through the top and bottom nozzles, and the speed v at which the plate is to be passed therethrough on the basis of the given plate size and cooling conditions. The values of i, $q_{Ui}$ and $q_{Li}$, and v are empirically determined for various plate sizes and cooling conditions and stored in the cooling control computer 5.

Rolling begins when the cooling conditions have been set. A pyrometer 8 checks if the plate M rolled on the rolling mill 1 has been finished at a desired temperature. Then the plate M is delivered to the cooling apparatus 3 for cooling.

A scanning pyrometer 10 upstream of the cooling apparatus determines the temperature distribution at the plate surface, with the obtained results inputted in the cooling control computer 5. The temperature distribution is determined by measuring the temperatures $\theta_{OC}$ and $\theta_{Oe}$ at the pre-selected representative points in the middle and edge portions of the plate.

On the basis of the cooling conditions and actually measured temperatures $\theta_{OC}$ and $\theta_{Oe}$, the temperatures $\theta_{Sc}$ and $\theta_{Fc}$ at which transformation begins and terminates in the middle portion and $\theta_{Fe}$ at which transformation in the edge portion terminates are determined so that the desired mechanical properties of the plate are obtained.

Figure 6:
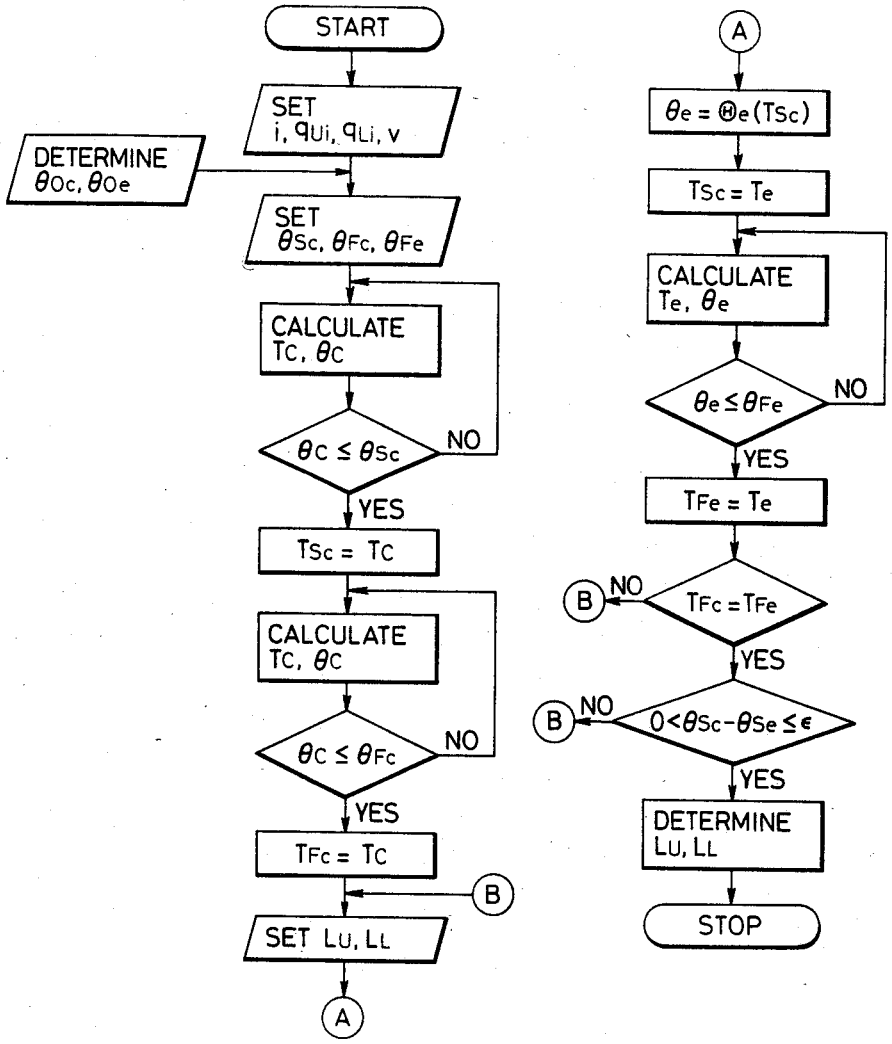
FIG. 6 is a flow chart showing the sequence of steps in which cooling conditions are set.
Figure 8:
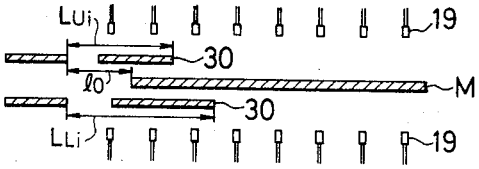
FIG. 8 shows the width over which shielding is provided.
Figure 7:
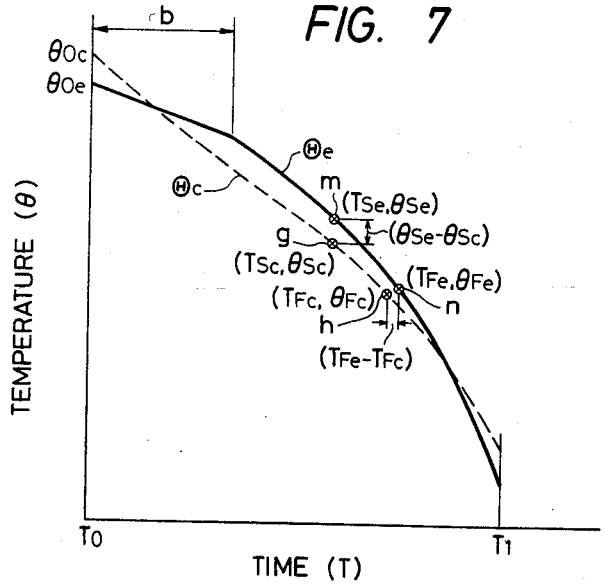
FIG. 7 shows cooling curves in terms of the relationship between time and temperature.

Then, the appropriate extents $L_{Ui}$ and $L_{Li}$ to which each cooling unit is to be shielded above and below the plate are determined by following the sequence of a flow chart shown in FIG. 6. The temperatures $\theta_{Sc}$ and $\theta_{Fc}$ and times $T_{Sc}$ and $T_{Fc}$ at which transformation begins and terminates in the middle portion are determined by calculating the temperature change with time in that portion. From the results thus obtained, a cooling curve $\theta_c$, which reaches from the time $T_O$ and temperature $\theta_{Oc}$ at which cooling begins through point g to point h, is derived as shown in FIG. 7.

The temperature $\theta$ is determined for each time increment $\Delta T$ by the differential method.

The ratio by which the temperature $\theta$ changes with respect to the time T is expressed as $$\frac{\Delta\theta_j}{\Delta T} = f(\alpha, y) \tag{1}$$

$$\alpha = g(w, \theta_{Sj}) \tag{2}$$

where $\alpha$ is the coefficient of heat transfer, y is the coordinate to show a point in the direction of plate thickness, w is the water flux density, and $\theta_{Sj}$ is the temperature at the surface of the plate. The suffix j shows the number of calculations repeated at intervals of time $\Delta T$.

The temperature $\theta_{j,k}$ for time T ($=j\Delta T$) at a given point in the direction of plate thickness (which is obtained by dividing the plate thickness by increments of $\Delta y$ and expressed by the distance $k\Delta y$ from the top or bottom surface of the plate) is expressed as follows:

Top surface:

$$\theta_{j,k} = \theta_{j-1,k} + \frac{2\lambda}{c\rho}\cdot\frac{\Delta T}{\Delta y^2}\left(\theta_{j-1,k+1} - \theta_{j-1,k} - \frac{\Delta y Q_{k+1}}{\lambda}\right) \tag{3}$$

where $$Q_{k+1} = \alpha_U(\theta_{j-1,k} - \theta_W) \tag{4}$$

$$\alpha_U = K_U W_U^{X_U}\mathrm{EXP}(Y_U) \tag{5}$$

$$X_U = a_{U0} + a_{U1}\theta_{SU} + a_{U1}\theta_{SU}^2 + \ldots + a_{Un}\theta_{SU}^n \tag{6}$$

$$Y_U = b_{U0} + b_{U1}\theta_{SU} + b_{U1}\theta_{SU}^2 + \ldots + b_{Un}\theta_{SU}^n \tag{7}$$

Bottom surface:

$$\theta_{j,k} = \theta_{j-1,k} + \frac{2\lambda}{c\rho}\cdot\frac{\Delta T}{\Delta y^2}\left(\theta_{j-1,k-1} - \theta_{j-1,k} - \frac{\Delta y Q_{k-1}}{\lambda}\right) \tag{8}$$

where $$Q_{k-1} = \alpha_L(\theta_{j-1,k} - \theta_W) \tag{9}$$

$$\alpha_L = K_L W_L^{X_L}\mathrm{EXP}(Y_L) \tag{10}$$

$$X_L = a_{L0} + a_{L1}\theta_{SL} + a_{L1}\theta_{SL}^2 + \ldots + a_{Ln}\theta_{SL}^n \tag{11}$$

$$Y_L = b_{L0} + b_{L1}\theta_{SL} + b_{L1}\theta_{SL}^2 + \ldots + b_{Ln}\theta_{SL}^n \tag{12}$$

Inside:

$$\theta_{j,k} = \theta_{j-1,k} + \frac{\lambda}{c\rho}\cdot\frac{\Delta T}{\Delta y^2}(\theta_{j-1,k+1} + \theta_{j-1,k-1} - 2\theta_{j-1,k}) \tag{13}$$

Throughout the above equations, $\lambda$ is the heat conductivity, c the specific heat and $\rho$ the specific weight of the steel plate. $\alpha_U$ and $\alpha_L$ are the coefficients of heat transfer at the top and bottom surfaces of the plate. $K_u$ and $K_L$, $a_{UO}$ to $a_{Un}$, $a_{LO}$ to $a_{Ln}$, $b_{U0}$ to $b_{Un}$, and $b_{LO}$ to $b_{Ln}$ are the constants dependent on the type, size and position of the nozzles which are determined empirically and on the basis of actual operating results. $\theta_W$ is the temperature of the cooling water.

The water flux densities $W_U$ and $W_L$ are determined by considering the width over which the cooling water is ejected, the extent to which the cooling water supply is cut off, and, when spray nozzles are used, the transition region between the regions in which the cooling water is ejected and cut off (since the cooling water ejected from a spray nozzle spreads in a fan-shaped fashion, the transition region means an area extending from immediately below the shielded nozzle to the area covered with the surface water where the water flux density changes continuously). When the water flux densities $W_U$ and $W_L$ are determined, the temperature distribution across the plate width can be determined using the equations given before. Of course the temperature distribution may be determined by taking measurements not only in the direction of plate thickness but also in the direction of plate width and length. But the calculation based on the measurements in the direction of plate thickness alone has proved to be adequate for practical purposes. The temperature $\theta$ may also be determined by use of other equations than those given above.

Next, the temperature change with time in the edge portion is determined by assuming the extents $L_{Ui}$ and $L_{Li}$ to which each cooling unit is to be sheilded above and below the plate. The temperature of the edge portion as determined at the time $T_{Sc}$ when transformation in the middle portion begins is defined as the temperature $\theta_{Se}$ at which transformation begins in the edge portion. After the time $T_{Se}$ and temperature $\theta_{Se}$ have been determined, the time $T_{Fe}$ and temperature $\theta_{Fe}$ at which transformation terminates are determined. On the basis of the results thus obtained, a cooling curve $\theta$ which reaches from the time $T_0$ and temperature $\theta_{Oc}$ at which cooling starts through point m to point n is derived as shown in Fig. 7. The range b on the cooling curve $\theta_e$ shows the period over which the water supply to the edge portion is cut off by means of the shielding plate. Then, it is judged if the conditions $T_{Fc} \leqq T_{Fe}$ and $0 < \theta_{Se} - \theta_{Sc} \leqq e$ are satisfied or not. The value of e chosen ranges between approximately 30° C. and 50° C. When the above conditions are not satisfied, the above calculation is repeated by assuming the appropriate values of $L_{Ui}$ and $L_{Li}$ anew. Assumption of $L_{Ui}$ and $L_{Li}$ should be started from a small value, with priority given to $L_{Li}$ for the bottom nozzles over $L_{Ui}$ for the top nozzles, and also to the cooling units closer to the entry end over those which are farther. The maximum and minimum values of $L_{Ui}$ and $L_{Li}$ are empirically determined beforehand. The obtained results are inputted in the plate travel speed control device 6, cooling water supply rate control device 7 and spray shielding control device. After the plate travel speed, the cooling water supply rate and the extent to which the spray nozzles are to be shielded have been set or preparation for such setting has been made, the plate M enters the cooling apparatus 3 and cooling therein begins. The middle and edge portion of the plate M are cooled substantially along the cooling curves $\theta_c$ and $\theta_e$ shown in FIG. 7.

On completion of cooling, the plate M is delivered to the subsequent process after the internal temperature distribution immediately after cooling has been determined by a scanning pyrometer 12.

The following paragraphs describe examples of experiments in which the cooling curves resulted from the cooling according to the method of this invention and the amount of plate deformation (or warpage) are compared with those resulting from the conventional method.

Table 1 shows the size of the plates and the cooling conditions employed in the experiments.

TABLE 1

Figure 9:
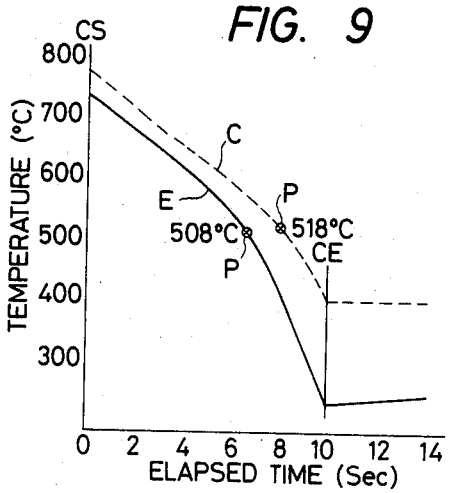
FIG. 9 to FIG. 11 are graphs showing some examples of cooling curves.
Figure 10:
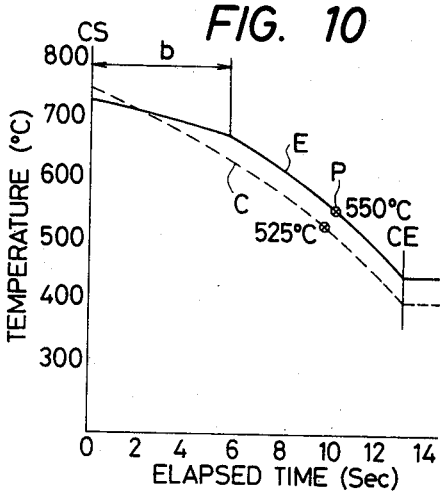
Figure 11:
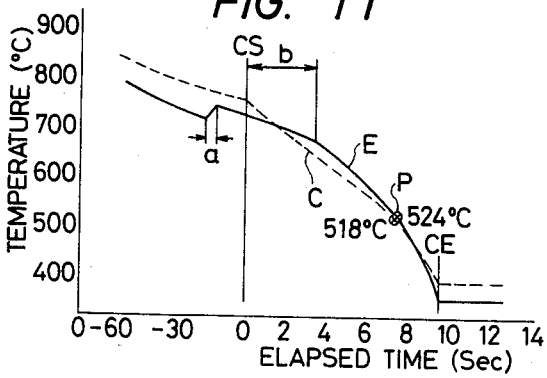
Figure 12:
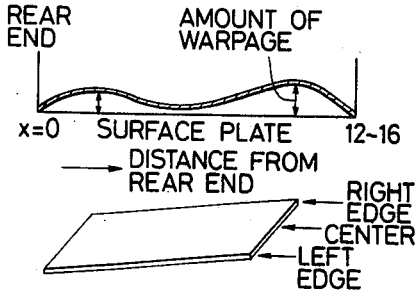
FIG. 12 shows how the extent of plate warpage induced by cooling is measured.
Figure 13:
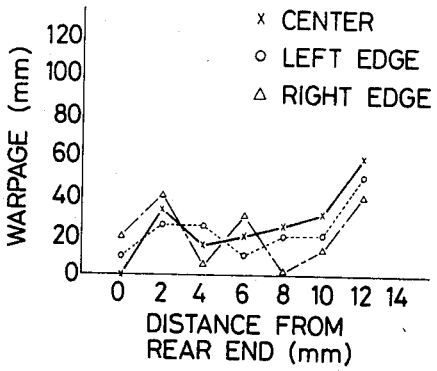
FIG. 13 to FIG. 15 are graphs showing examples of the cooling-induced plate warpages actually determined.
Figure 14:
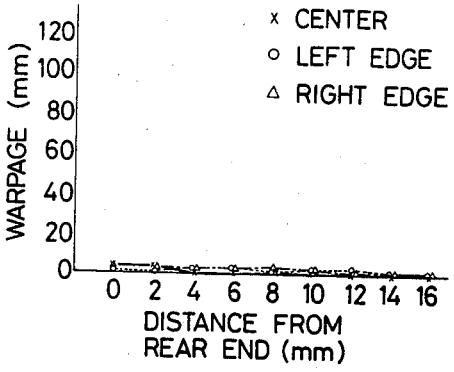
Figure 15:
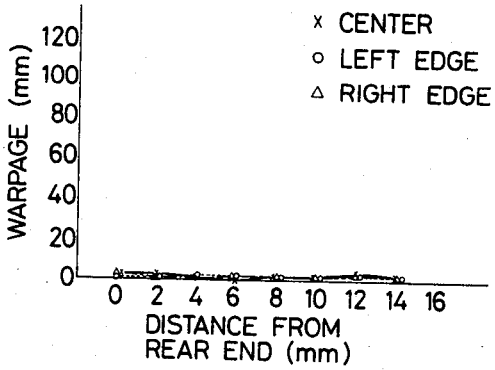

| | Conventional | This Invention - I | This Invention - II |
|---|---|---|---|
| Plate Size [Width(m) × Length(m) × Thickness (mm)] | 3.2 × 12 × 15 | 2.5 × 16 × 20 | 3.0 × 14 × 15 |
| Water Flux Density ($m/m^2min$) | | | |
| Top $q_{Ui}$ | 0.33 | 0.33 | 0.33 |
| Bottom $q_{Li}$ | 0.50 | 0.50 | 0.50 |
| Cooling Curve | FIG. 9 | FIG. 10 | FIG. 11 |
| Plate Warpage | FIG. 13 | FIG. 14 | FIG. 15 |

The number of nozzles shielded in the experiments shown in Table 1 are as given below. Cooling unit Nos. correspond to the serial numbers assigned to the individual cooling units starting from the one at the entry end of the cooling apparatus. The number of nozzles shielded is counted from the edge to the center of the plate. The negative number indicates the number of shielded nozzles off the edge of the plate. The nozzles are installed across the plate width at intervals of 75 mm.

| | This Invention - I | | | | | | | |
|---|---|---|---|---|---|---|---|---|
| Cooling Unit No. | 1 | 2 | 3 | 4 | 5 | 6 | 7 | 8 |
| No. of Top Nozzles Shielded | 6 | 5 | 4 | 3 | 1 | −1 | −1 | −1 |
| No. of Bottom Nozzles Shielded | 5 | 4 | 3 | −1 | −2 | −2 | −2 | −2 |

| | This Invention - II | | | | | |
|---|---|---|---|---|---|---|
| Cooling Unit No. | 1 | 2 | 3 | 4 | 5 | 6 |
| No. of Top Nozzles Shielded | 3 | 2 | 1 | −1 | −1 | −1 |
| No. of Bottom Nozzles Shielded | 2 | −1 | −2 | −2 | −2 | −2 |

FIGS. 9 to 11 show the cooling curves resulting from the cooling conducted under the conditions shown in Table 1. While FIG. 9 shows the cooling curves according to the conventional method, the other figures show the cooling curves obtained by the cooling method of this invention. FIG. 11 (Example II of this invention) shows the cooling curves obtained by heating the edge portion immediately before cooling.

Reference characters used throughout these figures are defined as follows: C=the temperature at the middle point of the width, E=the temperature of the inner edge portion (E for the conventional method shown in FIG. 9 is the temperature averaged over the thickness at an inward point 20 mm away from the plate edge. On the other hand, E for Cases I and II of this invention shown in FIGS. 10 and 11 indicates the temperature averaged over the thickness at an inward point where the highest temperature in the edge portion is reached; the point being 22 mm away from the edge in Case I shown in FIG. 10 and 19 mm away from the edge in Case II shown in FIG. 11), CS=the point where cooling begins, CE=the point where cooling terminates, P=the point where $Ar_3$ transformation occurs, b=the period over which the edge portion is covered with the shield plate, and a =the period over which localized heating is applied to the edge portion.

As will be obvious from the above figures, $Ar_3$ transformation occurred earlier in the inner edge portion than in the middle portion when cooling is accomplished by the conventional method. With the cooling method according to this invention, in contrast, $Ar_3$ transformation in the inner edge portion occurred simultaneously with or after that in the middle portion.

The amount of warpage on the plates cooled under the conditions given above was measured. By placing the cooled steel plate on a surface plate, the distance between the bottom surface of the steel plate and the top surface of the surface plate was measured. The longitudinal position of the steel plate is indicated by the distance from the rear end thereof.

The amounts of warpage thus determined are shown in FIGS. 13 to 15. As will be obvious from these figures, the cooling method according to this invention produces much less warpage than the conventional method.

Figure 16:
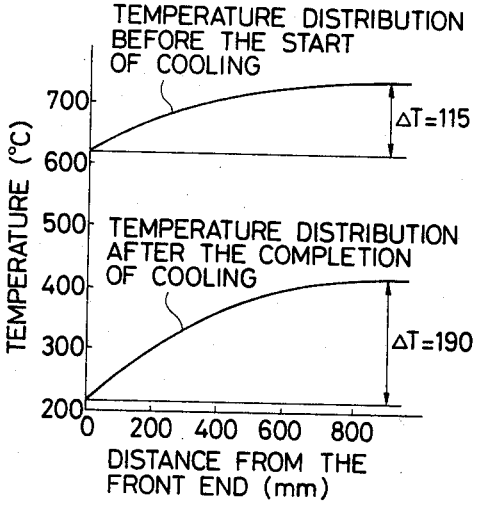
FIG. 16 graphically shows an example of the longitudinal temperature distribution in the front end of plate.

The foregoing discussion has been confined to the control of the temperature distribution across the plate width. Uneven temperature distribution can occur in the longitudinal direction, too. FIG. 16 shows an example of the longitudinal temperature distribution at the front end of steel plate. As will be seen, the temperature difference, which had been 115° C. before the start of cooling, increased to 190° C. after completion of cooling. The same applies to the rear end of plate, as well. Such a temperature difference can be eliminated by adjusting the quantity of water supply or the number of cooling unit on which all nozzles are simultaneously shielded in accordance with the distance from the front or rear end of the plate. To accomplish such an adjustment, as in the case of controlling the temperature distribution across the plate width, the temperature distribution across the plate length is determined before starting cooling. The number of cooling unit on which all nozzles are to be shielded is determined on the basis of the longitudinal temperature distribution thus determined and the predetermined mean cooling rate. The number of cooling unit to be thoroughly shielded is adjusted by means of a front and rear end shielding plate 41 shown in FIG. 4.

Figure 17:
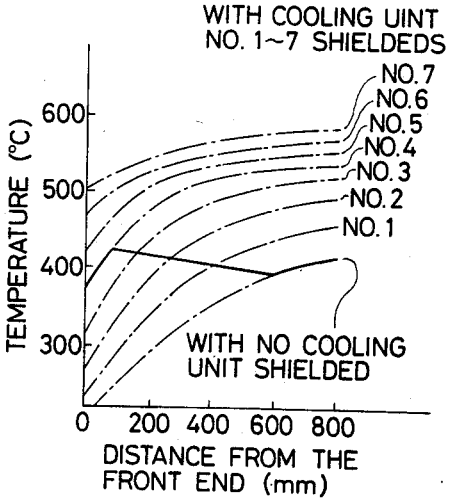
FIG. 17 graphically shows an example of the relationship between temperature and the distance from the front end of plate determined by shielding the nozzles of different cooling units.

FIG. 17 diagrammatically shows an example of the relationship between the distance from the front end of the plate and the temperature of the plate which is determined by using the cooling units whose nozzles are shielded as a parameter. The curves shown by dot-dash lines show the effects of the cooling units whose nozzles are shielded. If cooling is effected along the curve shown by a solid line, the temperature difference can be decreased from 190° C., the level mentioned previously, to approximately 30° C. At the front end, for instance, this can be achieved by thoroughly shielding up to the fourth cooling unit from the entry end of the cooling apparatus. For the portion not more than 400 mm away from the front end of the plate, the same control can be achieved by thoroughly shielding only the first cooling unit.

According to the method of this invention, hot steel plate is cooled in such a manner that the $Ar_3$ transformation in the inner edge portion occurs simultaneously with or after that in the middle portion by keeping the temperature of the inner edge portion above the temperature in the middle portion. In addition to such a widthwise controlled cooling, lengthwise controlled cooling based on the same principle can be applied to the front and rear ends of steel plate. Applying such a longitudinal controlled cooling to the front and rear ends of steel plate eliminates practically any off-material specification portion therefrom, with a resulting increase in production yield. Various types of cooling means may be used in combination depending upon the size, quality and required properties of the steel plate.

What is claimed is:

1. In a method of cooling hot steel plate as delivered from a preceding hot rolling line and passed longitudinally through pairs of top and bottom rollers disposed in the direction in which the steel plate travels by supplying cooling water to the top and bottom surfaces thereof from nozzles on a plurality of cooling units disposed in the same longitudinal direction, each cooling unit being interposed between adjoining pairs of said top and bottom rollers and at least some of the nozzles being disposed so as to direct cooling water onto a bottom side of the steel plate, which comprises the steps of:

determining the temperature distribution in the steel plate before starting cooling;

setting a desired mean cooling rate;

determining the distance from the plate side edges over which the supply of the cooling water at least to the bottom side of the steel plate is to be cut off on the basis of said temperature distribution and mean cooling rate so that the temperature of inner edge portions of the steel plate which are inside outer edge portions which are adjacent the plate edges, and outside a middle portion, are kept above the temperature of the middle portion so as to ensure that an $Ar_3$ transformation in the inner edge portions occurs simultaneously with or after an $Ar_3$ transformation in the middle portion; and cutting off the direct supply of the cooling water to the inner and outer edge portions of the steel plate at the bottom side of the steel plate over the distance determined in said distance determining step by shielding an appropriate number of nozzles thereon.

2. The improvement of claim 1, further comprising the steps of determining the temperature distribution of the steel plate in the longitudinal direction of travel thereof in order to attain a substantially uniform temperature distribution across the length thereof, decreasing the number of cooling units on which all nozzles are simultaneously shielded from the front end toward a longitudinally center portion of the steel plate on the basis of a determined temperature distribution, and increasing said number of cooling units from the longitudinally center portion toward a rear end of the steel plate.

3. The improvement of claim 1, further comprising the step of heating an inner edge portion of the steel plate in order to reduce the temperature difference between the middle and inner edge portions of steel plate immediately before starting cooling.

4. The improvement of claim 1, wherein said steps of cutting off direct supply of the cooling water includes the step of providing cut-off plates immediately below the inner and outer edge portions of the steel plate so as to cut the direct supply of cooling water thereto.

5. The improvement of claim 1, further comprising the steps of:

determining the longitudinal distance from at least one of the front and rear edges of the steel plate over which the supply of the cooling water at least to the bottom side of the steel plate is to be cut-off on the basis of said temperature distribution and mean cooling rate so that the temperature of at least one of a front and rear edge portion of the steel plate is made approximately uniform in said longitudinal direction as the temperature thereof approaches the $Ar_3$ transformation; and cutting off the direct supply of cooling water to the at least one of the front and rear edge portions over the longitudinal distance determined in said step of determining the longitudinal distance, by shielding an appropriate number of nozzles thereon.

* * * * *